United States Patent [19]

Hickman

[11] Patent Number: 4,472,913

[45] Date of Patent: Sep. 25, 1984

[54] NAILERLESS ROOF EDGE

[75] Inventor: John B. Hickman, Asheville, N.C.

[73] Assignee: W. P. Hickman Company, Asheville, N.C.

[21] Appl. No.: 534,268

[22] Filed: Sep. 22, 1983

Related U.S. Application Data

[63] Continuation of Ser. No. 191,714, Sep. 29, 1980.

[51] Int. Cl.[3] ..... E04D 13/15

[52] U.S. Cl. ..... 52/96; 52/731; 52/735

[58] Field of Search ..... 52/58–62, 52/94, 95, 96, 731

[56] References Cited

U.S. PATENT DOCUMENTS

| | | | |
|---|---|---|---|
| Re. 26,056 | 7/1966 | Hickman | 52/60 X |
| 164,602 | 6/1875 | Shepard | 52/96 |
| 674,379 | 5/1901 | Hard | 52/731 |
| 1,299,425 | 4/1919 | Carpenter | 52/672 |
| 1,337,840 | 4/1920 | Hawley | 52/60 |
| 1,740,753 | 12/1929 | Vallas | 52/58 |
| 1,782,246 | 11/1930 | Schneider | 52/60 |
| 2,136,122 | 11/1938 | Almdale | 52/731 |
| 2,160,758 | 6/1939 | Schurman | 52/96 |
| 2,219,992 | 10/1940 | Hanson | 52/96 |
| 2,250,548 | 7/1941 | Ness | 108/26 |
| 2,554,779 | 5/1951 | Goodwin | 72/86 |
| 2,734,602 | 2/1956 | Dawson | 52/97 |
| 2,755,484 | 7/1956 | Hotz | 4/172 |
| 2,793,403 | 5/1957 | Livingston | 20/4 |
| 2,855,776 | 10/1958 | Trostle | 52/300 |
| 2,857,861 | 10/1958 | Trostle | 52/94 |
| 2,920,477 | 1/1960 | Shaw . | |
| 3,012,376 | 12/1961 | Reddy et al. | 52/96 |
| 3,024,573 | 3/1962 | McKinley | 50/66 |
| 3,090,161 | 5/1963 | Edwards | 52/60 |
| 3,237,352 | 3/1966 | Edwards | 52/60 |
| 3,389,515 | 6/1968 | Hellebrand | 52/96 |
| 3,405,485 | 10/1968 | Edwards | 52/61 |
| 3,415,020 | 12/1968 | Windle | 52/96 |
| 3,444,658 | 5/1969 | Gobel | 52/60 |
| 3,447,273 | 6/1969 | Thom | 52/58 |
| 3,488,902 | 1/1970 | Gobel | 52/94 |

(List continued on next page.)

FOREIGN PATENT DOCUMENTS

| | | | |
|---|---|---|---|
| 603078 | 8/1960 | Canada . | |
| 1509147 | 11/1969 | Fed. Rep. of Germany | 52/58 |
| 1918761 | 10/1970 | Fed. Rep. of Germany . | |
| 1659340 | 1/1971 | Fed. Rep. of Germany | 52/96 |
| 2060292 | 6/1972 | Fed. Rep. of Germany . | |
| 2118981 | 10/1972 | Fed. Rep. of Germany . | |
| 7432 | of 1911 | United Kingdom | 52/731 |
| 1024071 | 3/1966 | United Kingdom . | |
| 1104027 | 2/1968 | United Kingdom . | |
| 1180965 | 2/1970 | United Kingdom . | |
| 1203344 | 8/1970 | United Kingdom . | |
| 1347974 | 2/1974 | United Kingdom . | |
| 2084628 | 4/1982 | United Kingdom | 52/96 |

OTHER PUBLICATIONS

Braas & Co. GmbH Brochure Entitled "PVC Flat--Roof Systems", (date unknown), 10 pp.

Braas Systems, Inc. Brochure No. 1004NA, Entitled "Purpose-Made Accessories for Braas Flat Roofs", dated 1/81 and 7/79, 10 pp.

*Primary Examiner*—James L. Ridgill, Jr.

*Attorney, Agent, or Firm*—Harness, Dickey & Pierce

[57] ABSTRACT

This disclosure relates to a roof edge assembly for use in forming a raised edge or gravel stop on a roof. The nailerless roof edge of the present invention eliminates the need for the piece of wood or nailer which is normally bolted to the top of a cement block wall for the purpose of fastening metal roof edges. The present roof edge assembly comprises a tab strip member which is adapted to be secured adjacent the edge of a roof using adhesive or other attaching means and which has special tab means thereon. The assembly further comprises a cant member having slot means therein adapted to mate with the tab means to secure the cant member to the tab strip member, and a fascia member which is adapted to be mounted on the cant member. The present invention provides for relatively simple, fast, and economical installation of roof edging and is adaptable to conventional roofing sealing membrane and insulation configurations.

21 Claims, 38 Drawing Figures

U.S. PATENT DOCUMENTS

| | | | |
|---|---|---|---|
| 3,503,162 | 3/1970 | Ward | 52/60 |
| 3,533,201 | 10/1970 | Tyler | 52/60 |
| 3,571,992 | 3/1971 | Comiskey | 52/60 |
| 3,608,255 | 9/1971 | Chomes | 52/61 |
| 3,624,973 | 12/1971 | Attaway | 52/60 |
| 3,719,010 | 3/1973 | Hickman | 52/60 |
| 3,731,439 | 5/1973 | Hickman | 52/61 |
| 3,802,140 | 4/1974 | Hickman | 52/300 |
| 3,812,634 | 5/1974 | Resech | 52/741 |
| 4,037,372 | 7/1977 | Patry | 52/96 |
| 4,071,987 | 2/1978 | Hickman | 52/94 |
| 4,241,549 | 12/1980 | Hall et al. | 52/60 |

FIG. 4a.
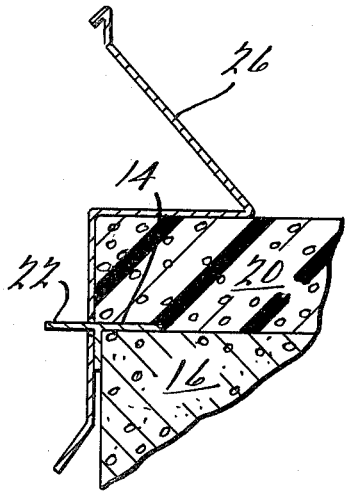
FIG. 4b.
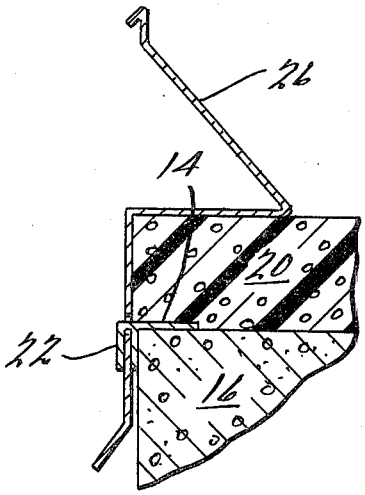
FIG. 5a.
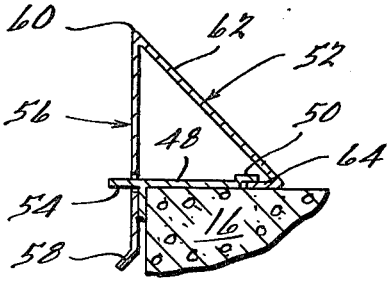
FIG. 5b.
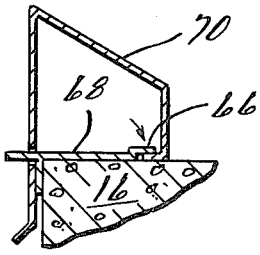
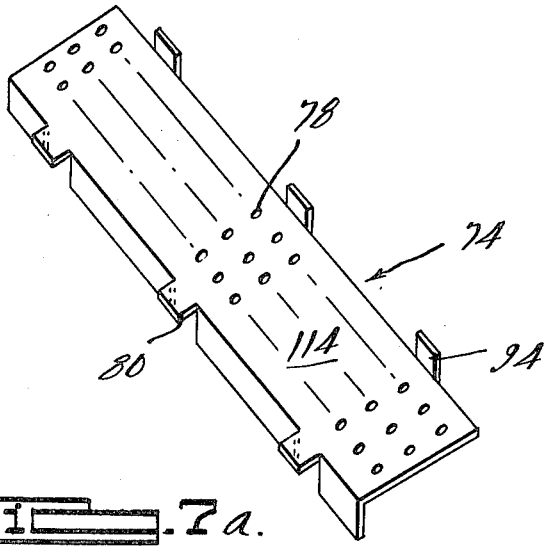
FIG. 7a.
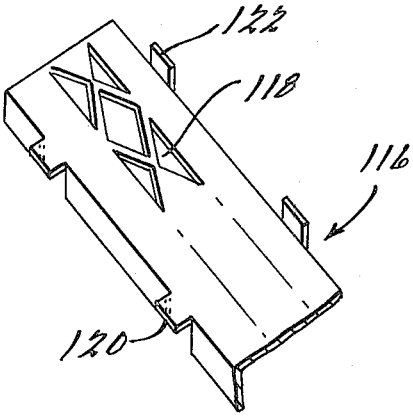
FIG. 7b.

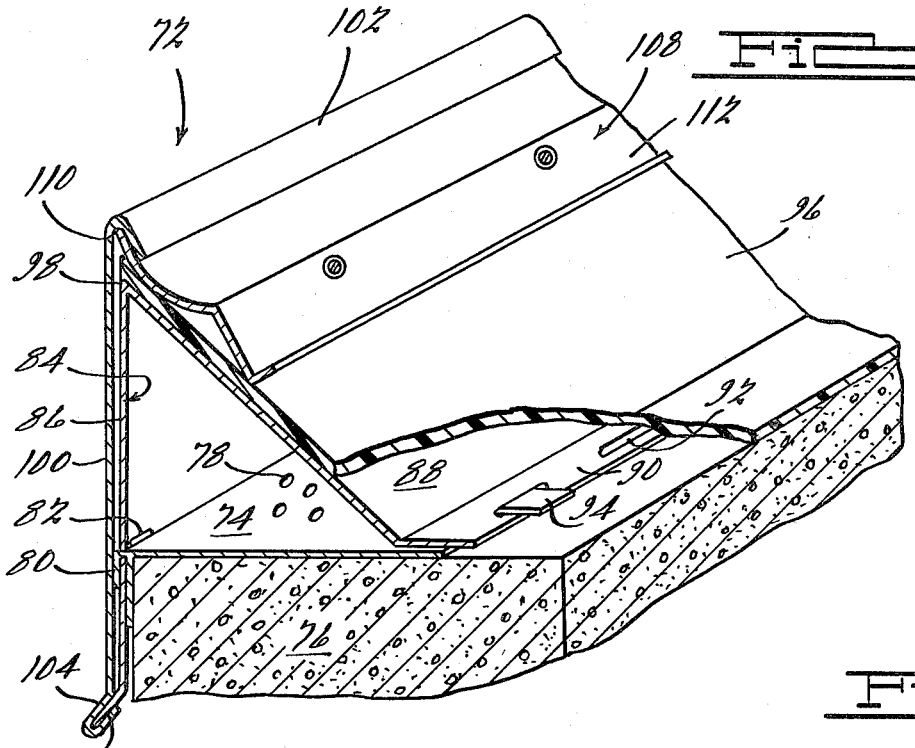
Fig. 6.
Fig. 7b.
Fig. 7c.
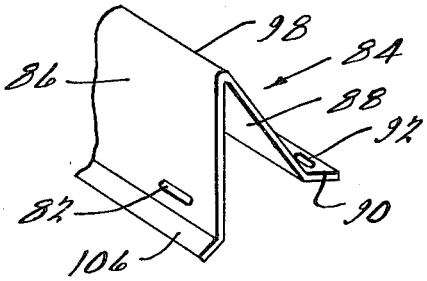
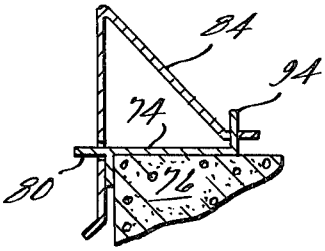
Fig. 8a.
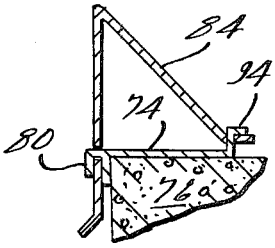
Fig. 9b.
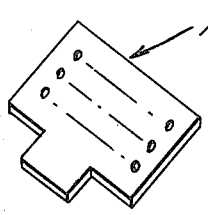
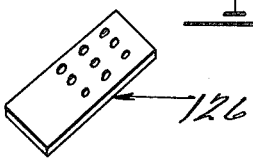
Fig. 9a.
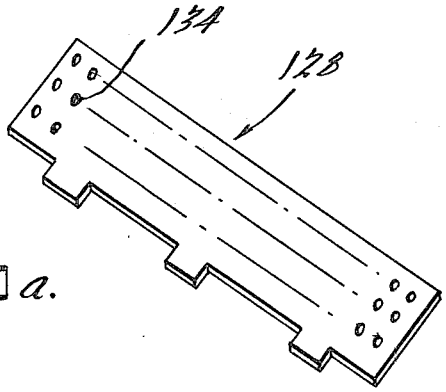
Fig. 10a.

136
130
138

140
132

142
146
148
144

156
150
154
152
158
160
162
164
166
168

174
170
172
180
176
178

190
192
198
196
194

182
186
184
188

NAILERLESS ROOF EDGE

This application is a continuation of application Ser. No. 191,714, filed Sept. 29, 1980.

BACKGROUND AND SUMMARY OF THE INVENTION

The present invention pertains primarily to building structures and more particularly to roof edge construction. Reference may be had to U.S. Pat. Nos. 4,071,987 and Re. 26,056, both owned by the same assignee as the present invention, to show treatment for the raised edge or gravel stop, and fascia at the top edge of a building. The disclosures of these two above-referenced patents are hereby incorporated in this application by reference.

It has generally been the practice in the erection of buildings having brick or cement block walls and metal roof edging, to bolt a piece of wood or nailer to the edge of the building on top of the last row of bricks or cement blocks. Metal edging is then fastened to this wood nailer. As simple as this procedure may appear in this over-simplified summary, the actual step-by-step process is very involved and requires the coordination of several workers, as will be explained below.

In order to get a wood stud or nailer in its desired location, first a wall is made, for example, out of cement blocks. When the wall is completed, steel J-bolts or threaded rods are embedded into the voids or cavities in the top row of blocks using concrete or the like. This contractor, typically a mason, usually fits a nut onto the exposed end of the threaded rod or bolt so that once the concrete has set, removing the nut will knock any rust off, since a clean threaded end is needed. Once the bolts are set and secured in place, a carpenter arrives at the job site with boards, generally 2×4's, 2×8's, or whatever width is needed. The carpenter must carefully drill and countersink these boards on exactly the right centers, remove the nuts from the exposed, threaded studs, drop the boards in place over the studs, and then, using a washer and the nut removed earlier, tighten the board down. This board, known as a nailer, is generally of pressure treated wood to retard rot. Finally, since it is difficult to set the studs exactly right, a steel worker is sometimes required to burn off the exposed ends of the studs which protrude above the top of the nailer. After all this has been completed, metal roof edging, of a type shown in the two above-referenced patents, for example, is fit into place by a sheet metal worker, who attaches a metal mounting member of some type to the wood studs using nails or the like.

It should thus be readily apparent that in addition to being a labor and time consuming effort, the above-described procedure also requires the coordination of four trades, namely a mason, a carpenter, a steelworker, and finally a sheet metal worker. In this day of "fast track" construction, the fewer trades that depend upon each other, the faster the schedule can be made. A fast schedule and rapid completion of construction projects saves money because construction loans do not have to be carried as long at current high interest rates. In addition, the complexity of the overall project is reduced significantly.

Accordingly, it is a principal object of the present invention to provide an improved roof edge assembly which eliminates the need for the piece of wood or nailer which is normally bolted adjacent the edge of a roof for the purpose of fastening metal roofing edges.

In general, the nailerless roof edge according to the present invention contemplates the use of a tab strip member which is adapted to be secured adjacent the edge of a roof on top of a block wall or the like. Since the wood nailer previously used in the art is eliminated, the tab strip member, which has tab means thereon, is secured directly to the edge of the roof using adhesive or other attaching means. The present roof edge assembly further comprises a cant member having slot means therein adapted to mate with the tab means to secure the cant member to the tab strip member, and also comprises a fascia member which is adapted to be mounted on the cant member.

The tab strip member may comprise a semi-flexible perforated strip with tabs protruding from it so that a slotted cant member can be slid over the tabs, with the tabs then being bent or hammered donw to lock the cant member in place. Although several different embodiments of the present invention are described herein, it should be appreciated that other variations or modifications are possible. In one tab strip configuration described herein, tabs protrude out of only one side of the tab strip member, while in another configuration, tabs protrude out of both sides of the tab strip member. As will be explained in more detail hereinbelow, these two different tab configurations are adapted for use with matching slotted cant members.

Additional advantages and features of the present invention will become apparent from a reading of the detailed description of the preferred embodiments which makes reference to the following set of drawings in which:

BRIEF DESCRIPTION OF THE DRAWINGS

FIGS. 4*a* and 4*b* and end views of the cant member of FIG. 1 mounted on the tab strip member of FIG. 1, both prior to and after, respectively, the protruding tab has been bent down;

FIGS. 5*a* and 5*b* are end views of two alternate cant member configurations, shown with a tab strip member having an offset horizontal element at its rearward end;

FIG. 6 is a perspective view, partially in section, of another preferred embodiment of the nailerless roof edge assembly of the present invention, shown mounted on the edge of a roof;

FIGS. 7*a*, 7*b*, and 7*c* are perspective views of two tab strip members and a cant member, respectively, of the type shown in FIG. 6;

FIGS. 8*a* and 8*b* are end views of the cant member of FIG. 6 mounted on the tab strip member of FIG. 6, both before and after, respectively, the protruding tabs have been bent down;

FIGS. 9*a*, 9*b*, 10*a*, 10*b*, and 10*c*, as well as FIGS. 11 to 27 show various tab strip member configurations suitable for use with the present invention.

DESCRIPTION OF THE PREFERRED EMBODIMENTS

Figure 1:
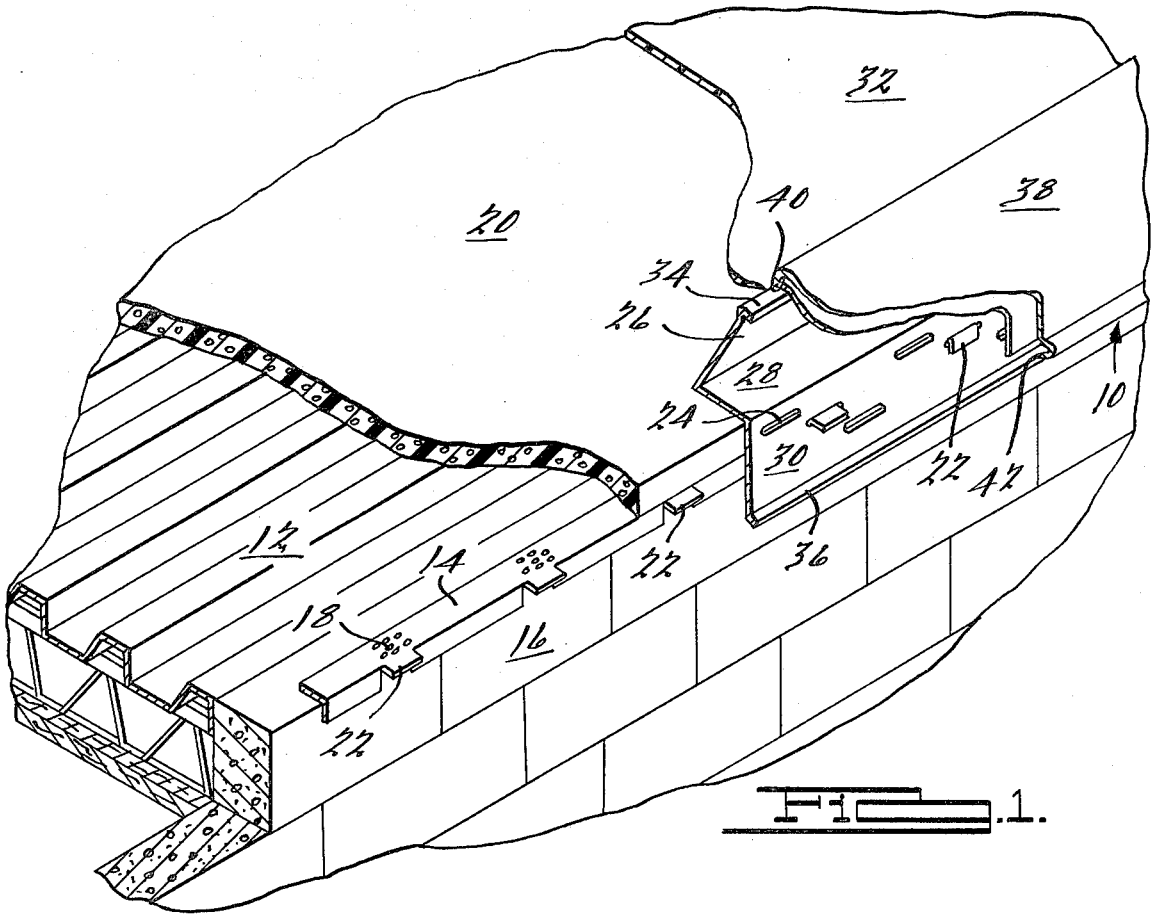
FIG. 1 is a perspective view, partially in section, of one preferred embodiment of the nailerless roof edge assembly of the present invention, shown mounted on a building.

Referring now to the drawings wherein the showings are for the purpose of illustrating several preferred embodiments of the present invention and are not for the purpose of limiting the invention, FIG. 1 shows one preferred embodiment of the nailerless rood edge assembly 10 of the present invention which is used to form a raised edge or gravel stop on a roof deck 12. This embodiment is particularly suited to be used with a gravel stop of the type described in U.S. Pat. No. 4,071,987, referred to hereinabove. A tab strip member 14 is secured to a top row of cement blocks 16 on the edge of a roof using adhesive or the like. The adhesive is allowed to flow somewhat through perforations 18 in the tab strip member 14 to improve adhesion. The extension of the adhesive through the perforations, while providing some additional holding force, primarily shortens the time required to set up the adhesive. Insulation 20 is then placed on top of the roof deck 12 and overlaps the upper horizontal surface of the tab strip member 14. The tab strip member 14 has a series of tabs 22 thereon which are mated with slots 24 in cant member or spring clip member 26. The cant member 26 is installed by positioning its lower horizontal supporting portion 28 on top of the insulation pad 20 and then sliding its vertical portion 30 into engagement with the top row of cement blocks 16. Of course, the slots 24 in the cant member would have to be aligned with the mating tabs 22 in the tab strip member 14 before the vertical portion 30 of the cant member could be brought up against the blocks 16. As shown in this figure, once the cant member has been placed along the vertical surface adjacent the roof, the tabs 22 are then bent or hammered down to secure the cant member 26 to the tab strip member 14.

Once the cant member or spring clip member is secure, a roofing sealing membrane 32 of elastomeric material or tar paper is placed on top of insulation 20. The roofing membrane 32 is brought up over the top edge 34 of the cant member 26 and is allowed to extend down to near the bottom edge 36 of the cant member. A fascia member 38, having a top channel element 40 and a bottom channel element 42 which face in opposite directions generally toward each other, is then positioned on the top edge of the cant member. The cant member is then deflected downwardly and released so as to have its top and bottom edges 34 and 36 respectively, enter the facing channel elements 40 and 42 respectively of the fascia member 38. Although not shown in FIG. 1, gravel is typically placed on top of the roofing sealing membrane 32.

Figure 2:
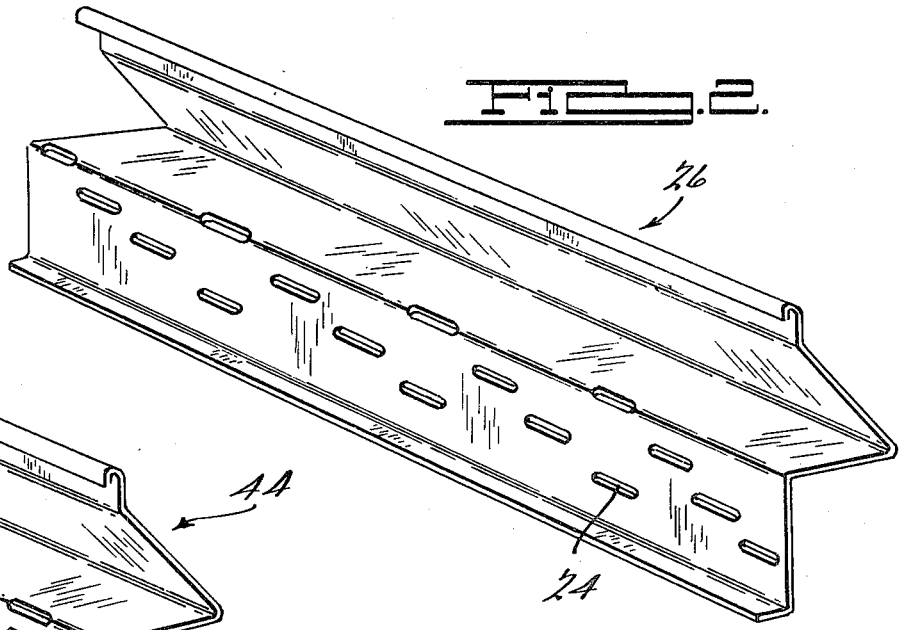
FIG. 2 is a perspective view of the cant member or spring clip member shown in FIG. 1.
Figure 3:
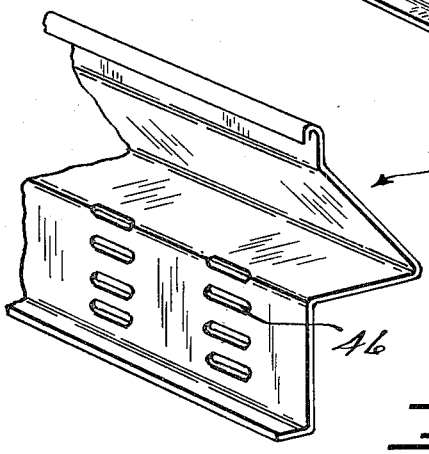
FIG. 3 is a perspective view of a cant member showing another possible slot configuration.

Referring now to FIGS. 2 and 3, two different arrangements of slots are shown in cant members 26 and 44 respectively. In both arrangements the slots appear at various levels to accommodate different thicknesses of insulation which would be installed under the slotted cant member. FIG. 2 shows slots 24 in a staggered arrangement, whereas FIG. 3 shows slots 46 in an in-line arrangement. From a manufacturing point of view, it is believed that staggered slots may be preferred, although both arrangements provide slots at at least four different levels. For custom insulation thicknesses, only one row of slots might be needed, and that row could be prefabricated at the factory to meet specific job conditions.

FIG. 4*a* illustrates the cant member 26 and the tab strip member 14 of FIG. 1 before the protruding tab 22 has been bent down. FIG. 4*b* illustrates the same cant member and tab strip member after the protruding tab 22 has been bent down to secure the cant member in place.

FIG. 5*a* shows a tab strip member 48 which has an offset horizontal element 50 at its back end which is adapted to engage a cant member or spring clip member 52. The forward side of this cant member 52 is slotted in a manner similar to the cant member of FIG. 1 so as to mate with a tab 54 in the tab strip member, and has a generally planar vertical portion 56 which extends from a bottom edge 58 to a top edge 60, before joining an angular portion 62 which slopes rearwardly to join a back leg 64 which engages the offset element 50 to support the cant member along the horizontal edge of the roof. FIG. 5*b* shows a somewhat similar construction in which an offset horizontal portion 66 on a tab strip 68 may be bent down, as indicated by the arrow, after cant member 70 is in place.

FIG. 6 shows another preferred embodiment of the nailerless roof edge assembly 72 of the present invention. This embodiment is particularly suited to be used with a combination water dam and gravel stop of the type described in U.S. Pat. No. Re. 26,056, referred to hereinabove. In this embodiment, a tab strip member 74 is secured to a top row of cement blocks 76 on the edge of a roof using adhesive or the like, which is allowed to flow somewhat through perforations 78 in the tab strip member 74 to improve adhesion. Although not shown in this figure, insulation, such as that illustrated in FIG. 1 may be placed on top of the roof deck so as to overlap the upper horizontal surface of the tab strip member 74 at its back end. The tab strip member 74 has a series of tabs 80 on its forward end which are mated with slots 82 in cant member 84. Cant member 84, which is generally in the shape of an inverted -V, has a vertical portion 86 having slots 82 near its bottom edge 106 which mate with tabs 80, and an angular portion 88, which has a horizontal support flange 90 on its rearwardmost end. Flange 90 has slots 92 therein which mate with tabs 94 formed on the rearward end of tab strip member 74. The flange 90 supports the cant member 84 along the horizontal edge of the roof.

Once the cant member or spring clip member 84 is secured, a roofing sealing membrane 96 is placed on top of the roof and brought up near the top edge 98 of the cant member. A fascia member 100, having a top channel element 102 and a bottom channel element 104 which face in opposite directions generally toward each other, is then positioned on the bottom edge 106 of the cant member, and moved so that the top channel element 102 engages the top edge 98 of the cant member 84. Although not absolutely necessary to the practice of the present invention, a rocker flashing 108 may be used to further secure the fascia member 100 to the cant member. As shown in FIG. 6, an upper edge 110 of the flashing 108 projects into the channel 102, with a lower portion 112 of the flashing being fastened to the angular portion 88 of the cant member 84 to secure the roof edge assembly. Gravel is then typically placed on top of the roofing sealing membrane 96. This particular configuration is explained in greater detail in U.S. Pat. No. Re. 26,056, as referred to above.

Referring now to FIGS. 7*a* and 7*b*, two different types of tab strip members are shown. The tab strip member 74 of FIG. 7*a* comprises a generally planar horizontal portion 114 having perforations 78 therein, a first set of horizontally extending tabs 80 on its forward edge, and a second set of vertically extending tabs 94 on its rearward edge. The tab strip member 116 of FIG. *7b* is of a configuration generally similar to that of the tab strip member of FIG. *7a,* however, rather than being perforated, the generally planar horizontal portion 118 is made of expanded metal. Both a first and second set of tabs 120 and 122 respectively, are used in this configuration. An expanded metal version is particularly attractive due to the fact that since the metal is laterally stretched, it goes further. Thus the final piece costs less.

FIG. *7c* more clearly shows the cant member 84 of FIG. 6. As described in connection with FIG. 6, this cant member comprises a vertical portion 86 joining a bottom edge 106 to a top edge 98. An angular portion 88 extends in a downward angle from the top edge 98 down to the horizontal support flange 90. Slots 82 are present in the vertical portion, while slots 92 are present in the horizontal flange 90. As with the cant member described in connection with FIG. 1, a variety of slot configurations may be fabricated into the cant member to accommodate various thicknesses of insulation or other structural variations. As before, the slots may simply be prefabricated in certain pre-specified locations to meet specific job conditions.

FIG. *8a* illustrates the cant member 84 and the tab strip member 74 of FIG. 6 before the protruding tabs 80 and 94 have been bent down. FIG. *8b* illustrates the same cant member and tab strip member after the protruding tabs have been bent down to hold the cant member in place.

It should of course be appreciated that the specific configurations of both the tab strip member and the cant member used with the present invention may be varied as necessary to suit particular needs. The following are examples of various tab strip member configurations which are adaptable for use with either of the preferred embodiments described above. Of course, an additional rearward tab would have to be added to accommodate a configuration of the type shown in FIG. 6.

FIGS. *9a* and *9b* illustrate tab strip members 124 and 126 respectively, which are of unit configuration. Such unit tab strips, which include a single tab thereon, could be individually positioned as necessary along a roof edge, thus eliminating the need for a single long tab strip having several tabs thereon. These tab strip members are shown as having perforations therein which aid in attachment to the edge of a roof.

FIGS. *10a, 10b,* and *10c* all show flat tab strip members 128, 130, and 132, respectively. However, different types of perforations are shown in each figure. FIG. *10a* shows perforations 134 which are continuous over the horizontal portion of the strip, whereas the perforations 136 shown in FIG. *10b* are localized on the horizontal portion of the strip adjacent the tabs 138. Perforations of the type shown in FIGS. *10a* and *10b* may be formed by punching out small holes in the sheet metal. However, as an alternative to punched-out perforations, FIG. *10c* shows a tab strip member 132 where the sheet metal has been burst or pierced to give the desired holes 140 in the horizontal portion of the strip.

Figures 10B, 10C, 11, 12, 13, 14, 15, 16, 17:
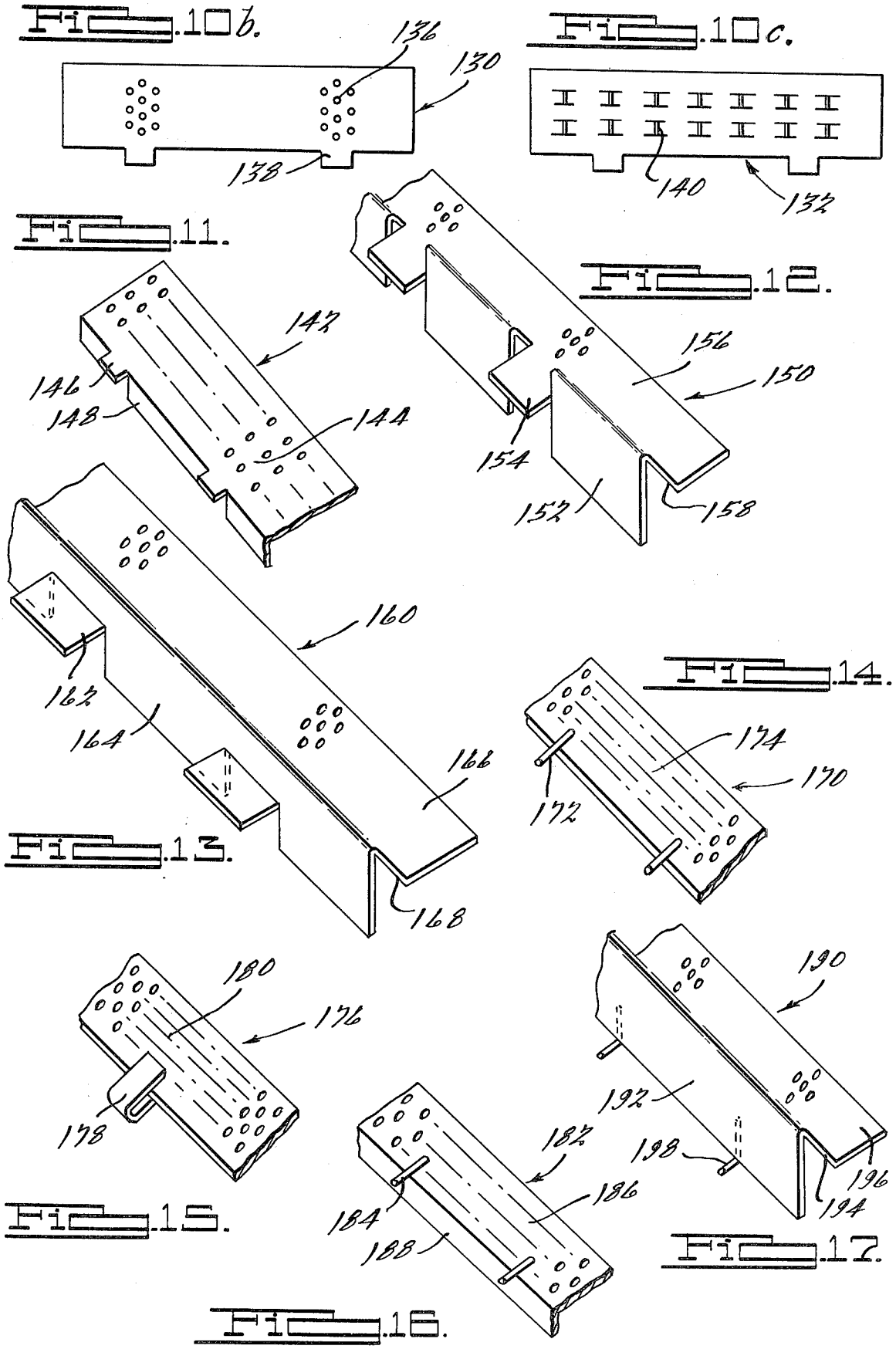

FIG. 11 illustrates a tab strip member 142 of the type shown in FIG. 1 wherein the strip is formed so as to contain a horizontal portion 144, tabs 146 coplanar and integral with the horizontal portion, and a series of downwardly-extending vertical flaps 148 which are formed out of the same piece of strip stock as the horizontal portion. The vertical flaps 148 are generally perpendicular to the horizontal portion 144. This particular configuration, as well as many of the others described herein, may also be used upside-down so that the vertical flaps extend upwardly.

FIG. 12 illustrates a tab strip member 150 wherein generally planar vertical flaps 152 extend both above and below the horizontal portion 156. Tabs 154 are coplanar and integral with the horizontal portion 156. The top edge of the vertical flaps joins an angular ramp 158 which is formed adjacent the horizontal portion. The ramp has its base on the horizontal portion and is inclined up to a point of contact with the top edge of the vertical flaps. FIG. 13 shows a tab strip member 160 somewhat similar to FIG. 12, however the tabs 162 are formed out of a vertical portion 164 rather than from a horizontal portion 166. The tabs 162 are still generally coplanar with the horizontal portion. The vertical portion 164 has a ramp 168 on its rearward side and extends both above and below the horizontal portion 166.

FIG. 14 illustrates a compound or "two-piece" tab strip member 170 wherein the tabs 172 comprise wires or bolts or the like which are secured to the horizontal strip 174 by such methods as soldering, gluing, brazing, welding, etc. FIG. 15 illustrates another compound tab strip member 176 wherein the tabs 178 comprise a metal strip folded over so that it contacts both the upper and lower surfaces of the horizontal portion 180 of the strip. The metal strip forming the tabs 178 may likewise be soldered, glued, brazed, welded, etc. to the horizontal portion 180 of the strip.

FIG. 16 illustrates a compound, formed tab strip member 182 wherein wire or bolt tabs 184 are attached to a strip having a continuous horizontal portion 186 and a downwardly extending vertical portion 188 which is generally perpendicular to the horizontal portion. This configuration is also particularly suited for use upside-down. FIG. 17 illustrates another compound, formed tab strip member 190 which is somewhat similar to the configuration of FIG. 13 in terms of its vertical portion 192, ramp 194, and horizontal portion 196. However, rather than having formed tabs as in FIG. 13, the configuration of FIG. 17 uses wire or bolt tabs 198, which are generally L-shaped and attached to the back side of the vertical portion 192, as shown.

Figure 18:
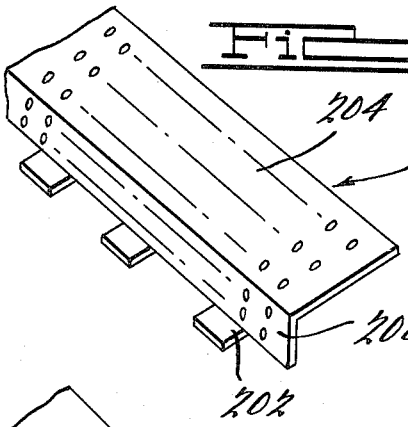
Figure 19:
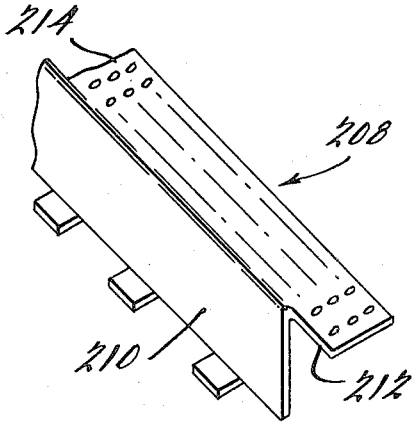
Figure 20:
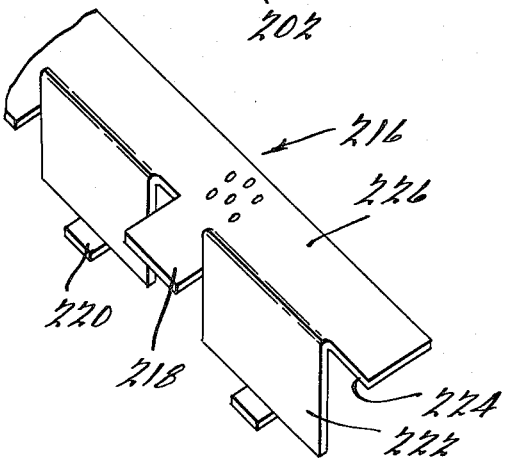

FIG. 18 illustrates a tab strip member 200 wherein tabs 202 are offset from rather than coplanar with the horizontal portion 204 such that the tabs 202, vertical portion 206, and horizontal portion 204 form a step-like configuration. It is also noteworthy that this particular configuration shows perforations on both the horizontal and vertical portions, although both sets of preforations are not necessary to the practice of the present invention. It should of course be appreciated that such a distribution of perforations is equally adaptable to the other tab strip configurations disclosed herein. FIG. 19 illustrates a tab strip member 208 having a vertical portion 210, ramp 212, and horizontal portion 214 similar to the strip shown in FIG. 17. However, the tab of FIG. 19 is integrally formed and is offset like the tab in the strip of FIG. 18. FIG. 20 illustrates yet another tab strip member 216 which is similar to the strip of FIG. 19, except that it contains an upper horizontally extending tab 218, in addition to the lower horizontally extending tab 220, which is formed out of part of the vertical portion 222 and ramp 224 of this strip. The upper tab 218 is coplanar with rather then offset from the horizontal portion 226.

Figure 21:
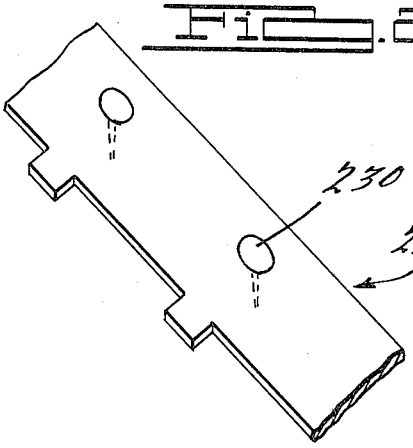

FIG. 21 illustrates a tab strip member 228 which may be fastened to the edge of a roof using masonry fasteners 230 or the like.

Figure 22:
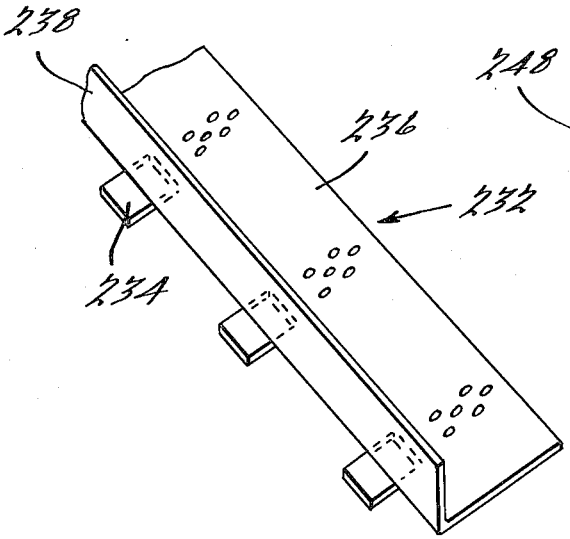
Figure 23:
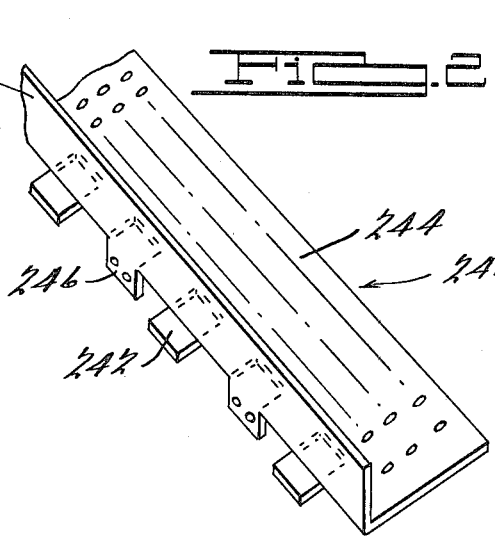

FIG. 22 illustrates a tab strip member 232 wherein tabs 234 are punched out from the underside of a horizontal portion 236 so as to be coplanar with the horizontal portion. A vertical portion 238 extends upwardly from and is generally perpendicular to the horizontal portion 236. FIG. 23 illustrates a somewhat similar tab strip member 240 having tabs punched out from underneath, wherein a first set of tabs 242 is coplanar with a horizontal portion 244 and a second set of tabs 246 is coplanir with a vertical portion 248. This type of configuration would aid in aligning the strip on the corner of a block wall, since the horizontal portion 244 and tabs 246 would help position the strip.

Figure 24:
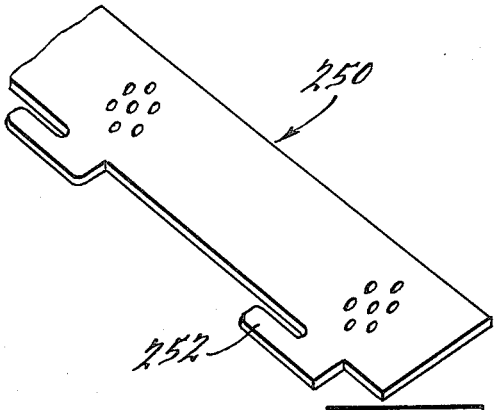
Figure 25:
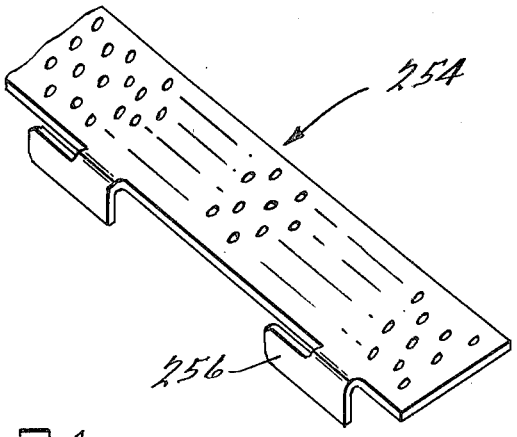
Figure 26:
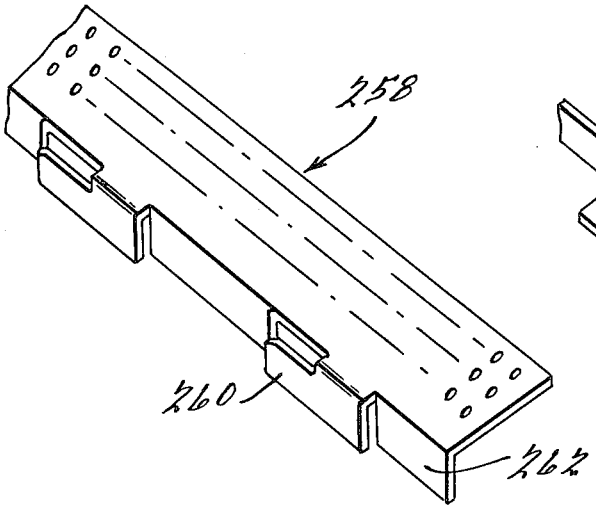

FIG. 24 illustrates a tab strip member 250 wherein tabs 252 are generally hook-shaped. Such a configuration would allow the slots of a mating cant member or spring clip member to be placed over the tabs and then shifted laterally to help insure that the cant member is attached once the tabs are bent over. FIG. 25 illustrates a somewhat similar tab strip member 254 in whih the tabs 256 are both hook-shaped and bent over prior to installation of a mating cant member. Thus a cant member would be secured solely by a lateral shift rather than by bending over any tabs, as is the case of most of the other embodiments shown herein. FIG. 26 illustrates a tab strip member 258 in which bent over, hook-shaped tabs 260 are offset from a vertical portion 262 to provide a gap and give more clearance for lateral movement of a mating cant member.

Figure 27:
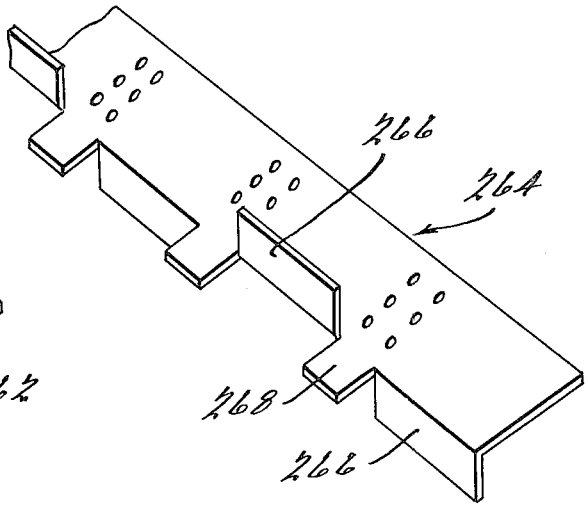
Figure 28A:
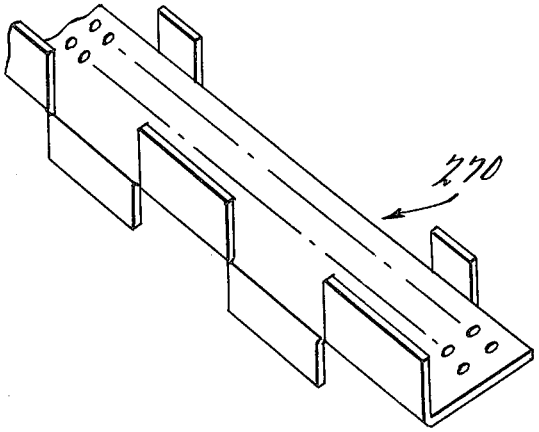
FIGS. 28*a* and 28*b* show yet another configuration of the nailerless roof edge assembly of the present invention.
Figure 28B:
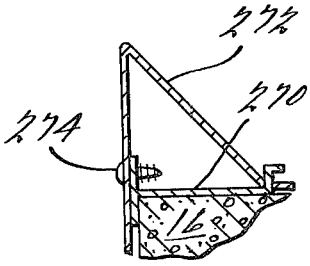

FIG. 27 illustrates a tab strip member 264 wherein upwardly and downwardly directed vertical flaps 266 alternate direction between tabs 268. In a further modified form of this configuration, FIG. 28*a* illustrates a tab strip member 270 similar to the strip of FIG. 27 except with no protruding tabs on its face. As seen in FIG. 28*b*, a cant member 272 would be secured to the tab strip member 270 using such manual tabbing means 274 as screws, pop-rivets, or the like. Holes or slot means would be provided in the mating cant member to receive the screws or rivets.

The tab strip member, cant member, and fascia member used with the present invention may be made of such material as galvanized steel sheet. Besides galvanized metal, aluminum, stainless steel, plastic, or the like may also be used. The various components may also be painted or coated as necessary for both protective and decorative purposes. Needless to say, the tab strip member should be relatively flexible or ductile so that the tabs thereon can be bent over without too much effort. Also, the tab strip member should be flexible enough to be able to deform or compensate for any irregularities in the cement blocks or concrete.

Among the advantages of the present invention, in addition to those described above, is that since a wood nailer is no longer necessary along the roof edge, the cost of material and labor of installing wood nailers is eliminated, and furthermore there is no concern for rotting wood. Since the roof edge assembly of the present invention comprises parts made from sheet metal or the like, the roof edge assembly allows any insulation layer to breathe at the roof edge where it counts most. The usual problem of trapped water is likewise virtually eliminated. The nailerless roof edge assembly of the present invention also provides for simple, fast, and economical installation, but yet has been shown to provide respectable holding power of about 200 pounds per foot in certain constructions. Since the installation of the nailerless roof edge assembly of the present invention would probably be the responsibility of a single contractor, namely a sheet metal worker or the like, no carpenters, masons, or steel workers would be needed. Job scheduling is thus simplified, as is the time necessary for completion of various jobs. The relative simplicity of the assembly and installation procedure likewise makes it ideal for renovation, or repair work, as well as new construction.

Although most of the description of the present invention given above has been directed to a roof edge assembly, it should be appreciated that the principles of the invention are equally applicable to other edges on building structures, such as corners, windows, doorways, or the like.

While it will be apparent that the preferred embodiments of the invention disclosed are well calculated to fulfill the objects above stated, it will be appreciated that the invention is susceptible to modification, variation, and change without departing from the proper scope or fair meaning of the subjoined claims.

What is claimed is:

1. An edge assembly for use in forming an edge on a building structure comprising:

a relatively flexible tab strip member having integral tab means thereon and being securable adjacent the edge of the building, said tab means including a portion protruding in a direction generally away from said building, a cant member comprising a vertical portion having slot means therein which mate with said tab means to secure said cant member to said tab strip member, said slot means comprising a hole though said cant member for receiving said protruding portion of said tab means, said cant member having top and bottom edges, and having means for supporting said cant member along the horizontal edge of the building, and a fascia member having channel elements along the top and bottom edges which face in opposite directions generally toward each other, the top and bottom edges of said cant member being engagable with said channel elements to support said fascia member.

2. The invention of claim 1 wherein said tab strip member includes a plurality of tab means.

3. The invention of claim 1 wherein said tab strip member has perforations therethrough and is secured along the edge of the roof by adhesive which is placed between said tab strip member and the edge of the roof and is allowed to flow into said perforations.

4. The invention of claim 3 wherein said perforations are continuous over said tab strip member.

5. The invention of claim 3 wherein said tab strip member comprises a generally horizontal portion and a generally downwardly extending vertical portion substantially perpendicular to said horizontal portion, and wherein both of said portions have perforations therethrough.

6. The invention of claim 2 wherein said tab strip member includes a generally horizontal portion adapted to overlay the horizontal edge of the roof.

7. The invention of claim 6 wherein said tab means are generally coplanar with said horizontal portion.

8. The invention of claim 6 wherein said tab strip member further includes a generally vertical portion substantially perpendicular to said horizontal portion.

9. The invention of claim 8 wherein said vertical portion extends generally downwardly from said horizontal portion.

10. The invention of claim 1 wherein said cant member comprises a plurality of slot means.

11. The invention of claim 10 wherein said slot means comprise a series of spaced apart slots, each series being arranged in a step-like pattern.

12. The invention of claim 10 wherein said slot means comprise a series of spaced apart slots, each series being in substantial vertical alignment.

13. A roof edge assembly for use in forming a raised edge on a building structure comprising:

a relatively flexible tab strip member having integral tab means thereon and being securable adjacent the edge of the roof, said tab means including a portion protruding in a direction generally away from said building, a cant member comprising a vertical portion having slot means therein which mate with said tab means when aligned with a vertical surface adjacent the roof to secure said cant member to said tab strip member, said slot means comprising a hole through said cant member for receiving said protruding portion of said tab means, said cant member having top and bottom edges, a horizontal portion for supporting said cant member along the horizontal edge of the roof, and an angular portion connecting said horizontal portion to said top edge, and a fascia member having channel elements along the top and bottom edges which face in opposite directions generally toward each other, the top and bottom edges of said cant member extending within said channel elements when said angular portion of said cant member is deflected downwardly and released to have the top and bottom edges thereof enter the facing channel elements of the fascia member which is supported thereby.

14. A roof edge assembly for use in forming a raised edge on a building structure comprising:

a relatively flexible tab member having integral tab means thereon and being securable adjacent the edge of the roof, said tab means including a portion protruding in a direction generally away from said building, said tab strip member having a horizontal portion for overlaying the horizontal edge of the roof, a cant member comprising a vertical portion having slot means therein which mate with said tab means when aligned with a vertical surface adjacent the roof to secure said cant member to said tab strip member, said slot means comprising a hole through said cant member for receiving said protruding portion of said tab means, said cant member having top and bottom edges, and having means for engaging the horizontal portion of said tab strip member for supporting said cant member along the horizontal edge of the roof, and a fascia member having channel elements along the top and bottom edges which face in opposite directions generally toward each other, the top and bottom edges of said cant member engaging said channel elements when said cant member is deflected to have the top and bottom edges thereof engage the facing channel elements of the fascia member which is supported thereby.

15. The invention of claim 14 wherein said horizontal portion on said tab strip member includes an offset horizontal element and wherein said cant member is adapted to engage said offset horizontal element to support said cant member along the horizontal edge of the roof.

16. A roof edge assembly for use in forming a raised edge on a building structure comprising:

a relatively flexible tab strip member having a horizontal portion for overlaying the horizontal edge of the roof and having first and second integral tab means thereon, each of said tab means including a portion protruding in a direction generally away from said building, said tab strip member being securable adjacent the edge of the roof, a cant member comprising a vertical portion having first slot means therein which mate with said first tab means when placed along a vertical surface adjacent the roof to secure said cant member to said tab strip member, said slot means comprising a hole through said cant member for receiving said protruding portion of said tab means, said cant member having top and bottom edges, a horizontal portion having second slot means therein which mate with said second tab means for supporting said cant member along the horizontal edge of the roof, and an angular portion connecting said top edge to said horizontal portion, and a fascia member having channel elements along the top and bottom edges which face in opposite directions generally toward each other, the top and bottom edges of said cant member engaging said channel elements when said cant member is deflected to have the top and bottom edges thereof engage the facing channel elements of the fascia member which is supported thereby.

17. The invention of claim 16 wherein said first tab means is generally coplanar with said horizontal portion on said tab strip member, and wherein said second tab means is generally perpendicular to said horizontal portion on said tab strip member.

18. An edge assembly for use in forming an edge on a building structure comprising:

a relatively flexible tab strip member having integral tab means thereon and being securable adjacent the edge of the building, said tab means including a portion protruding in a direction generally away from said building, a cant member having slot means therein which mate with said tab means to secure said cant member to said tab strip member, said slot means comprising a hole through said cant member for receiving said protruding portion of said tab means, said cant member having top and bottom edges, and having means for supporting said cant member along the horizontal edge of the building, and a fascia member having channel elements along the top and bottom edges which face in opposite directions generally toward each other, the top and bottom edges of said cant member being engageable with said channel elements to support said fascia member.

19. An edge assembly according to claim 18, wherein said tab means protrudes in a generally horizontal direction relative to said building.

20. An edge assembly according to claim 18, wherein said tab means protrudes in a generally vertical direction relative to said building.

21. An edge assembly according to claim 18, wherein said tab means includes at least one tab protrusion protruding in a generally horizontal direction relative to said building and at least one tab protrusion protruding in a generally vertical direction relative to said building.

* * * * *